United States Patent [19]

Yashiro

[11] 4,024,748

[45] May 24, 1977

[54] APPARATUS FOR PRODUCING ANNULAR METALLIC BLANKS FOR METALLIC RINGS

[75] Inventor: Kazuyoshi Yashiro, Kure, Japan

[73] Assignees: Bendo Kogyo Co., Ltd.; Mitsubishi Jidosha Kogyo Kabushiki Kaisha, Tokyo, both of Japan

[22] Filed: Nov. 4, 1975

[21] Appl. No.: 628,735

[30] Foreign Application Priority Data

Mar. 11, 1975 Japan ..... 50-29353
Sept. 11, 1975 Japan ..... 50-110428

[52] U.S. Cl. ..... 72/391; 29/156.62; 29/412; 59/35 R; 72/424; 72/427

[51] Int. Cl.² ..... B21D 11/06

[58] Field of Search ..... 72/129, 130, 427, 424, 72/391; 29/156.62, 412; 140/88; 10/86 B; 59/35, 12

[56] References Cited

UNITED STATES PATENTS

| | | | |
|---|---|---|---|
| 1,161,001 | 11/1915 | Merritt | 140/88 |
| 1,801,363 | 4/1931 | Mueller | 29/412 |
| 2,128,437 | 8/1938 | Stenwall | 59/35 |
| 3,613,195 | 10/1971 | Senior | 59/12 |
| 3,938,235 | 2/1976 | Wendt | 29/412 |

*Primary Examiner*—C.W. Lanham
*Assistant Examiner*—Gene P. Crosby
*Attorney, Agent, or Firm*—Wenderoth, Lind & Ponack

[57] ABSTRACT

An apparatus for producing annular metallic blanks for metallic rings having a desired inner diameter wherein a length of elongated metallic material having a predetermined cross-sectional configuration is formed into a spiral shape having an inner diameter smaller than the desired diameter of the ring and such formed material is forcibly and coaxially disposed around a cylindrical portion of a holding means having a diameter larger than the inner diameter of the ring. Thereafter, the spiral formed material around the cylindrical portion is cut along a straight line parallel to the axis of the cylindrical portion to provide a plurality of metallic bends, and the bends are removed from the cylindrical portion to be used as annular metallic blanks for the metallic rings. In order to obtain a desired ring from the annular blank formed as described above, the ends of the annular blank are later joined together by welding such as by a butt welding operation.

8 Claims, 9 Drawing Figures

APPARATUS FOR PRODUCING ANNULAR METALLIC BLANKS FOR METALLIC RINGS

BACKGROUND OF INVENTION

This invention relates to a method and apparatus for producing metallic rings which are, for example, employed to fabricate starting ring gears for a motor vehicle or the like, and in particular, to a method and apparatus for producing annular metallic blanks for the metallic rings.

There are two conventional methods for producing steel rings which are employed to fabricate ring gears or the like.

In one of the conventional methods for producing steel rings, an elongated steel material such as a steel bar is bent into an annular shape and, then, the ends of such formed steel material are joined together by a welding operation. However, according to this method, when the steel material is bent into an annular shape, the ends of the material are left unformed or straight because the ends are held by gripping means while the material is being bent. Thus, when the ends of the annular material are welded together, the straight ends have to be cut off, and then the ends of the remaining material which has been bent to a predetermined curvature are welded together. The cut off ends are waste. Furthermore, the ends formed by cutting off the straight parts of the annular material are separated from each other, and they have to be butted against each other before they are welded together. The butting operation, however, results in application of an excess amount of stress to the material which may cause deformation of the material into oval or the like shape other than a true circle. In order to check and rectify the deviation from the desired true circular shape, further labor is required and checking and rectifying operations add an additional cost to the production of the rings. Furthermore, since any steel material generally has a variation or deviation in carbon content therein over the length of the material, various portions of the steel material will have somewhat different curvatures, and rectifying operations of such different curvatures also require additional labor and expense.

In the second conventional method, a thick steel cylinder is sliced into a plurality of rings, the diameter of the steel cylinder having a predetermined diameter the same as that of the desired ring products so that the rings formed are, themselves, used as ring products.

In this method, however, a substantial amount of material is wasted as cutting chips when the steel cylinder is sliced, thus resulting in an increase in production cost. Furthermore, the obtained rings are subjected to uneven stress while they are being cut from the steel cylinder and in consequence, the configuration of the obtained rings will come to be distorted, even if the steel cylinder has a relatively precise circular configuration. Such distortion of configuration has to be corrected or rectified and, as with the first conventional method described above, this requires a substantial increase in man hours and expenditure.

SUMMARY OF INVENTION

Accordingly, it is a object of the present invention to provide a novel and improved method and apparatus for producing annular blanks for rings having a desired diameter.

Another object of the invention is to provide a method and apparatus which make it possible to produce annular blanks for rings having precise circular configurations with a high production efficiency while eliminating waste of material.

A further object of the invention is to provide a method and apparatus which make it possible to produce annular blanks for rings having no deviation or variation in curvature of the rings.

A still further object of the invention is to provide a method and apparatus which make it easy to produce rings having a desired diameter without substantial variation in radius of curvature.

According to the present invention, a length of elongated metallic material having a predetermined cross-section configuration is formed into a spiral shape having an inner diameter smaller than the desired diameter of the ring, and such formed material is forcibly and coaxially disposed around a cylindrical portion of a holding means having a diameter larger than the inner diameter of the ring. Thereafter, the spiral formed material around the cylindrical portion is cut along a straight line parallel to the axis of the cylindrical portion to provide a plurality of metallic bends, and the bends are removed from the cylindrical portion to be used as annular metallic blanks for the metallic rings.

In order to obtain a desired ring from the annular blank formed as described above, the ends of the annular blank are joined together by welding such as by a butt welding operation.

The above and other objects and attendant advantages of the present invention will be more readily apparent to those skilled in the art from a reading of the following detailed description in conjunction with the accompanying drawings which show preferred embodiments of the invention for the purpose of illustration only, but not for limiting the scope of the same in any way.

DESCRIPTION OF PREFERRED EMBODIMENT

In the production of annular blanks according to the present invention, first of all, a length of elongated metallic material such as a steel strip or bar having a predetermined cross-section such as a rectangular circular or any other cross-sectional configuration is formed into a spiral-shaped member 1. In forming the metallic material into the spiral-shaped member 1, the material is subjected to a series of conventional cold-bending steps to form a plurality of turns which have an inner diameter smaller than that desired for the metallic rings which are the final product obtained from the spiral metallic member 1.

Figure 1:
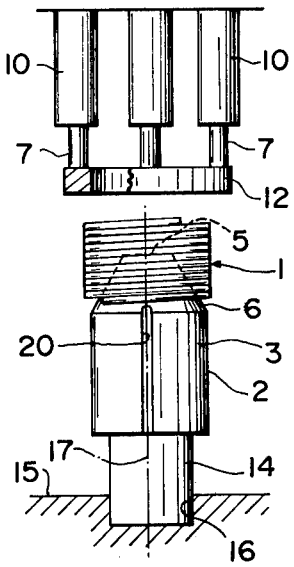
FIG. 1 is a front elevational view of a preferred embodiment of an apparatus for producing annular blanks for ring constructed in accordance with the present invention and showing the apparatus in an initial stage in the annular blank producing operation in which a spiral member is initially put on the holding means.
Figure 2:
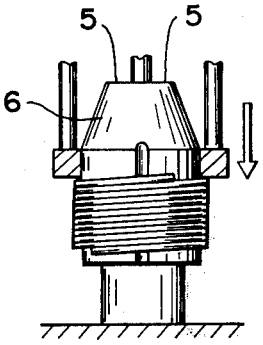
FIG. 2 is a view similar to FIG. 1, but shows the apparatus in a second stage in the annular blank producing operation in which the spiral material has been placed on the holding means in the apparatus.

The spiral member 1 is at first placed about or put on a cylindrical portion 3 of a holding means 2, the cylindrical portion 3 having an outer diameter greater than the inner diameter of the desired metallic ring product. In the embodiment illustrated, the holding means 2 has an upper frusto-conical portion or reducing diameter portion 6 integral with and extending upwardly from the cylindrical portion 3. The diameter or taper of the frusto-conical portion 6 gradually reduces toward the flat top 5 which has a diameter smaller than that of the spiral member 1 so that the spiral member can be easily displaced around the cylindrical portion 3 by forcibly sliding the member along the tapered peripheral surface of the frust-conical portion 6 (see FIG. 1). In order to effect such operation, means for forcibly displacing the spiral member is provided. In the preferred embodiment, a plurality of spaced vertically extending cylinder means 10, 10 . . . are provided above the holding means 2 and suitably supported on a suitable support member (not shown) and each of the cylinder means has a vertically reciprocal rod 7 to push the spiral member 1 downwardly along the cylindrical portion 3 of the holding means 2 upon the downward stroke of the rod 7. A pusher ring 12 is fixedly secured to the lower ends of the rods 7, 7 . . . and has an inner diameter slightly greater than the outer diameter of the cylindrical portion 3. As more clearly shown in FIG. 2, when the cylinder means 10, 10 . . . are actuated to drive their rods 7, 7 . . . in their downward stroke the spiral member 1 which has been placed on the frusto-conical portion 6 is forcibly pushed downwardly along the frusto-conical portion 6 and the cylindrical portion 3 to a predetermined position about the cylindrical portion, whereupon the cylinder means 10 are reversed to drive the associated rods 7 upwardly away from the holding means 2 to their respective retracted positions. The holding means 2 further includes a reduced diameter base portion 14 integral with and extending downwardly from the cylindrical portion 3, and the base portion is releasably held in position within a pit 16 provided in a suitable support structure 15.

Figure 3:
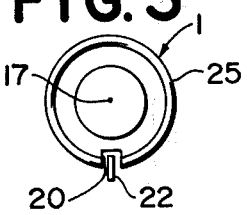
FIG. 3 is a top plan view of the apparatus showing how the turns of spiral material are cut to provide a plurality of split annular blanks.

With the spiral member 1 held in the predetermined position referred to above about the cylindrical portion 3, the spiral member is cut along a vertical line parallel to the axis 17 of the holding means 2. In the illustrated embodiment, a straight vertical groove 20 is provided in the outer surface of the holding means 2 along a vertical line parallel to the axis 17 of the holding means 2 extending the height of the cylindrical portion 3 and a portion of the frusto-conical portion 6, and the cutter of a cutting means 22 (see FIG. 3) is guided along the vertical groove 20 to cut the spiral member along the groove to provide a plurality of bends 25.

Figure 4:
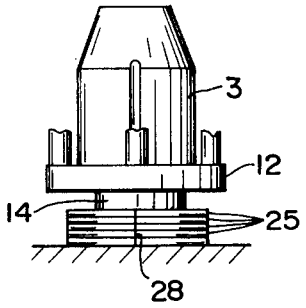
FIG. 4 is a front elevational view of the apparatus showing the split annular blanks having been moved along the holding means to the bottom thereof.
Figure 5:
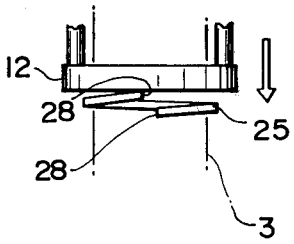
FIG. 5 is a fragmentary view in elevation of the apparatus showing the initial stage of the removal step of the split annular blanks from the holding means.
Figure 6:
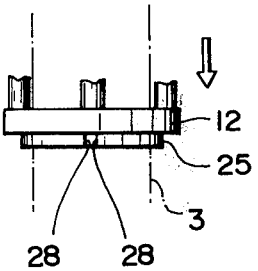
FIG. 6 is a front explanative elevation view showing how to remove the annular blanks from the holding means.

For removing the bends 25 from the holding means 2, in the illustrated embodiment, the cylinder means 10 are again actuated to drive their rods 7 and accordingly, the pusher ring 12 downwardly along the holding means 2 until the bends 25 leave the cylindrical portion 3 whereupon the bends drop by gravity to the extreme lower end of the base portion 14 as shown in FIG. 4. Should the bends 25 be left as they have been formed, the ends 28, 28 of each of the bends 25 are not in alignment with each other or not in the same horizontal plane as shown in FIG. 5. However, when the cylinder means 10 are actuated to drive their rods and accordingly, the pusher ring 12 in the downward stroke to apply a downward force onto the bends 25, the ends 28, 28 of the bends are caused to oppose each other as shown in FIG. 6. When the bends 25 are removed from the cylindrical portion 3 of the holding means 2 onto the reduced diameter base portion 14, the ends 28, 28 of the bends 25 are allowed to abut against each other as shown in FIG. 4 due to the restoration or return-to-original position characteristic inherent in the metallic material of the bends 25 to provide annular ring blanks which can then be subjected to further processing to be employed in particular applications.

Finally, the base portion 14 of the holding means 2 is pulled out of the pit 16 in the support structure 15 so that the thus formed annular blanks can be removed from the device.

When it is desired to produce a metallic ring from each of the thus formed annular blanks, it is only necessary to weld the ends 28, 28 of each of the blanks together e.g. by a so-called butt welding operation.

In this connection, it is to be noted that the inner circumferential length of the annular blank is dimensioned to include the inner circumferential length of the desired ring and the length of material to be consumed in butt welding and, hence, the outer circumferential length of the cylindrical portion 3 should be dimensioned to include the inner circumferential length of the annular blank as described above and the length of the material consumed as metal cutting chips in cutting of the spiral member. Incidentally, flash butt welding is preferable because it is easy to control the length of material of the ends to be consumed in a flash butt welding operation. Further, when a starting ring gear is required, the ring formed as described above is subjected to a gear cutting process with a gear cutting machine such as gear hobbing machine.

Figure 7:
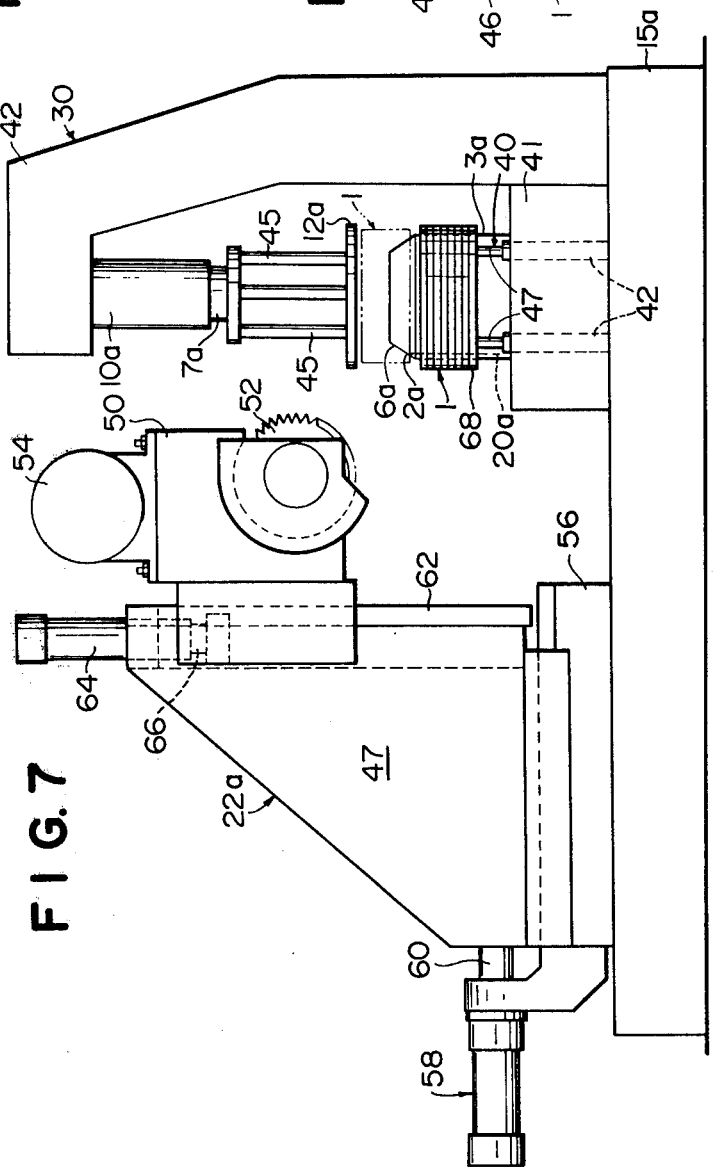
FIG. 7 is a front view of another apparatus in accordance with the present invention.

Referring to FIG. 7, there is shown an apparatus of another embodiment of the present invention. This apparatus is generally similar to that shown in FIGS. 1 – 6. The apparatus comprises a bed frame 15*a*, a holding means 2*a*, a spiral member pushing means 30 having a pusher ring 12*a*, and a cylinder means 10*a*, a cutting means 22*a* and a spiral member removing means 40.

Figure 8:
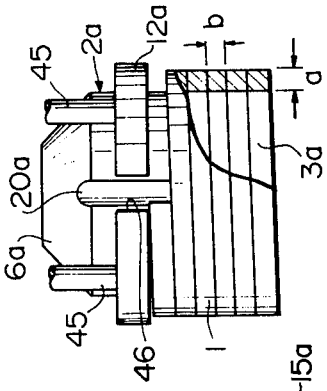
FIG. 8 is a partial diagrammatic view of the holding means and the spiral member pusher means of the apparatus shown in FIG. 7 in the annular blank producing operation in which the spiral member has been placed on the holding means in this apparatus.

The holding means 2*a* includes a cylindrical portion 3*a* fixedly mounted on a stand member 41 fixed to the bed frame 15*a* and a frusto-conical portion 6*a*. The cylinder means 10*a* is suspended from a frame 42 fixed on the bed frame 15*a* and is positioned above the holding means 2*a*. The pusher ring 12*a* is connected to a reciprocatable rod 7*a* of the cylinder means 10*a* by the medium of a plurality of connecting rods 45, 45 . . . The ring 12*a* is preferably provided with a notched 46 aligned with the cutting blade relief groove 20*a* of the holding means 2*a* as shown in FIG. 8 so that cutting blade can pass through the notch 46 in the cutting operation of the spiral member as described hereinafter.

The cutting means 22*a* comprises a body 47 and a cutting head 50 having a rotary cutter 52 and a motor 54 therefore. The body 47 is mounted on a horizontal rail 56 fixed on the bed frame 15*a* for horizontal movement and is driven by a horizontal fluid cylinder device 58 connected by a rod 60 of the device 58. The cutting head 50 is slidably mounted on a vertical rail 62 for vertical movement and is driven by a fluid vertical cylinder device 64 which is connected to the cutting head 50 by a rod 66. The cutting operation is preferably effected by the combination of the operation of the motor 54 and both the cylinder devices 58 and 64. The cylinder means 58 and 64 illustrated in FIG. 7 as means for operating the cutting device may be replaced by gear means including a pinion and rack or the like.

The removing means 40 comprises a plurality of cylinder means 42, 42 . . . positioned around the lower portion of the cylindrical portion 3*a* and secured to the bed frame 15*a* and a pusher ring 68 fixedly connected to the rods 47, 47 . . . of the cylinder 42, 42 . . . The pusher ring 68 is loosely and coaxially disposed around the lower portion of the cylindrical portion 3*a* so as to engage the lower end face of the spiral member 1 put on the cylindrical portion 3*a* and is preferably provided with a cutter blade relief notch (not shown) aligned with the groove 20*a* in the same manner as groove 46 in the pusher ring 12*a*.

The annular blank producing operation of this apparatus is effected in the same manner as described in connection with the first embodiment shown in FIGS. 1 – 6 except for the operation as described below. That is, in the operation of this apparatus, the spiral member is, as partially shown in FIG. 8, clamped by the upper and lower pusher rings 12*a* and 68 while it is being subjected to the cutting operation by means of the cutting means 22*a*. Thus, the cutting operation can be stably effected and the ends of the metal bends formed from the spiral member by the cutting operation are opposed to each other by the clamping force applied by both of the rings. Thus, the ends of each bend removed from the cylindrical portion 3*a* are positioned in abutting relationship to make the bend into an annular blank. Furthermore, the operation for removing the spiral member is effected such that the upper pusher ring 12*a* is retracted from the holding means 2*a* to its original position after the cutting operation and, then, the lower pusher ring 68 is upwardly driven by the cylinder means 45, 45 . . . so that the spiral member which has been subjected to the cutting operation is removed from the holding means 2*a*.

Figure 9:
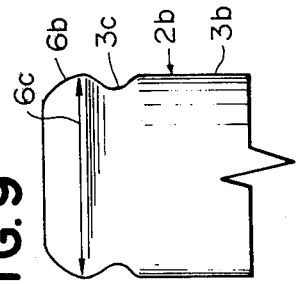
FIG. 9 is a front view of a modified holding means used in the apparatus of the present invention.

In FIG. 9, an alternative embodiment of the holding means 2*b* is shown. The means 2*b* comprises a cylindrical portion 3*b*, a reducing diameter portion 6*b* which functionally corresponds to the frusto-conical portion 6 shown in FIGS. 1, 2, 4 and 7 and a constricted portion 3*c* between the portions above 3*b* and 6*b*. When the cylindrical portion and the diameter reducing portion or frusto-conical portion of the holding means are continuously formed without the constricted portion 3*c* as illustrated in FIGS. 1, 2, 4 and 7, all of the turns of the spiral member which pass the diameter reducing portion or frusto-conical portion are directly put onto or engaged with the cylindrical portion the diameter of which is larger than the inner diameter of the spiral member and, thus, there is required a substantial force to push the spiral member in opposition to the frictional force caused between the cylindrical portion and all the turns of the spiral member passing the diameter reducing portion and engaging with the cylindrical portion. However, in the initial stage of the pushing operation for disposing the spiral member about the cylindrical portion of the holding means, there are retained many turns in the upper portion of the spiral member which are not yet engaged with the cylindrical portion. Thus, such turns in the upper portion of the spiral member are unstable and have a tendency to laterally move with respect to the axis of the spiral member so that it may become difficult to smoothly effect the pushing operation of the spiral member.

Contrary to the above, in the embodiment shown in FIG. 9, turns which have passed the maximum diameter portion 6*c* of the diameter reducing portion 6*b* are temporarily and loosely positioned about the constricted portion 3*c* and, thereafter, become engaged with the cylindrical portion 3*b* by a further pushing operation. Thus, it becomes possible to put relatively many turns in the lower portion of the spiral member on the holding means with a pushing force smaller than that required in the embodiment shown in FIGS. 1, 2, 4 and 7, and thus, the pushing operation can be stably effected.

To further illustrate the practice of this invention, dimensional data are shown in the table below:

Table (mm)

| A × b | ID | OD | B | C |
|---|---|---|---|---|
| 16 × 16 | 361.3 | 392.3 | 359 | 366.75 |
| 17.5 × 10.5 | 261.3 | 395.3 | 257 | 266.43 |
| 20 × 11 | 240.9 | 280.9 | 237 | 247.10 |

The data concern examples only of the steel rings for starting ring gears obtained in production based on this invention.

In the table above, *a* and *b*, respectively, represent the width and height of cross-sectional configuration of the steel material used for making the spiral member (see FIG. 8), ID and OD represent an inner diameter and outer diameter of the ring obtained, respectively, B represents the inner diameter of the spiral member and C represents the outer diameter of the cylindrical portion of the holding means. In the examples shown above, the length of the material loss consumed as cutting chips in the cutting operation is about 3.5 mm.

In the production of starting ring gears, the material for making the spiral member 1 is rectangular in cross-section; however, when other ring products are desired, other cross-sectional configurations such as circular, triangular, etc. may be employed. Taking into consideration the deformation of the cross-sectional configuration caused in making the spiral member from the (straight) material, for example, in the production of starting ring gears, the material may be tapered so that the height of the cross-sectional configuration is gradually decreased toward one side from another side thereof so that the cross-sectional configuration of the spiral member is made to be substantially rectangular.

According to the present invention, since a preformed spiral member is forcibly applied about the cylindrical portion of the holding means having an outer diameter greater than that of the spiral member, deviation or variation in the radius of curvature in several portions of the spiral material 1, which may be inevitable when an annular blank is formed by merely bending the metallic material such as steel as by conventional methods, for instance due to variation in carbon content, with respect to the length of the material can be eliminated to thereby solve the difficulty inherent in the first conventional method referred to hereinabove. Furthermore, when a ring is formed by the employment of the annular blank produced by the present invention, since the ends of the blank are allowed to abut against each other by virtue of the restoration or return-to-original shape characteristic of the material of the annular blanks, it is not necessary to apply any external force at the ends of the blank when the ends are welded together as required in the first conventional method, and thus, the present invention makes it easy to produce a ring having a desired diameter without substantial variation in the radius of curvature.

Furthermore, it will be appreciated that material loss in the production of an annular blank is less as compared with the above-mentioned conventional methods and a more precise ring can be produced.

In the illustrated embodiment of the apparatus of the invention, 2,500 annular blanks for rings can be produced with one apparatus per one working day, eight hours, and this represents a capacity over 10 times as high as that of the conventional methods. By virtue of the abovementioned features of the present invention, blank production cost by the present invention can be reduced by 40 to 50 percent as compared with the conventional methods.

In the foregoing description has been made of only one embodiment of the invention, but it will readily occur to those skilled in the art that the same is illustrative only, but does not limit the scope of the invention in any way. The scope of the invention is only limited by the appended claims.

I claim:

1. An apparatus for producing metallic annular blanks for rings having a predetermined inner diameter from a preformed metallic spiral member which has an inner diameter smaller than said predetermined inner diameter of said rings, said apparatus comprising:

a holding means having a cylindrical portion with an outer diameter greater than said predetermined inner diameter of said rings and a frusto-conical portion provided on one end of said cylindrical portion, the diameter of the tip portion of the frusto-conical portion being smaller than said inner diameter of said spiral member;

means for forcibly applying said spiral member about said cylindrical portion of said holding means, said applying means including a substantially annular pusher member having an inner diameter slightly greater than the outer diameter of said cylindrical portion, said pusher member being drivable along the axis of said cylindrical portion so as to push said spiral member placed on said frusto-conical portion onto said cylindrical portion;

means for cutting said spiral member on said cylindrical portion along a straight line parallel to the axis of said cylindrical portion to provide a plurality of metallic bends; and means for removing said bends from said cylindrical portion of said holding means to use the bends as said metallic annular blanks.

2. An apparatus as claimed in claim 1, further comprising at least one cutting blade relief groove formed in the outer periphery of said cylindrical portion of said holding means in parallel to the axis of said cylindrical portion, so that a cutting blade of said cutting means is allowed to pass through said groove when said spiral member is cut.

3. An apparatus as claimed in claim 1, wherein said means for removing said bends from said cylindrical portion includes a substantially annular pusher member having an inner diameter slightly larger than said outer diameter of said cylindrical portion, said pusher member being drivable along the axis of said cylindrical portion in a coaxial relationship to said cylindrical portion so as to push said bends along said cylindrical portion to thereby remove said bends from said cylindrical portion.

4. An apparatus as claimed in claim 3, wherein the outer circumferential length of said cylindrical portion of said holding means is dimensioned to be equal to the sum of the inner circumferential length of said ring, the length of material loss to be consumed as cutting chips in said cutting operation, and the length of material to be consumed in a butt welding operation for joining the ends of said each annular blank together to make said ring.

5. An apparatus for producing metallic annular blanks for rings having a predetermined inner diameter from a preformed metallic spiral member which has an inner diameter smaller than said predetermined inner diameter of said rings, said apparatus comprising:

a holding means having a cylindrical portion with an outer diameter greater than said predetermined inner diameter of said rings;

means for forcibly applying said spiral member about said cylindrical portion in a substantially coaxial relationship to the cylindrical portion;

means for cutting said spiral member on said cylindrical portion along a straight line parallel to the axis of the cylindrical portion to provide a plurality of metallic bends; and means for removing said bends from said cylindrical portion of said holding means to use said bends as said metallic annular blanks, said removing means including a substantially annular pusher member having an inner diameter slightly larger than said outer diameter of said cylindrical portion, said pusher member being drivable along the axis of said cylindrical portion in a coaxial relationship to said cylindrical portion so as to push said bends along said cylindrical portion to thereby remove said bends from said cylindrical portion.

6. An apparatus as claimed in claim 5, wherein the outer circumferential length of said cylindrical portion of said holding means is dimensioned to be equal to the sum of the inner circumferential length of said ring, the length of material loss to be consumed as cutting chips in said cutting operation, and the length of material to be consumed in a butt welding operation for joining the ends of said each annular blank together to make said ring.

7. An apparatus as claimed in claim 5, further comprising at least one cutting blade relief groove formed in the outer periphery of said cylindrical portion of said holding means in parallel to the axis of said cylindrical portion, so that a cutting blade of said cutting means is allowed to pass through said groove when said spiral member is cut.

8. An apparatus as claimed in claim 5, wherein said holding means further includes a reducing diameter portion, and a constricted portion formed between said reducing diameter portion and said cylindrical portion.

* * * * *